US010441993B2

(12) United States Patent
Galdamez Morales et al.

(10) Patent No.: US 10,441,993 B2
(45) Date of Patent: Oct. 15, 2019

(54) VERTICAL TWISTING SYSTEM AND METHOD

(71) Applicant: LEAR CORPORATION, Southfield, MI (US)

(72) Inventors: Jessica Arlene Galdamez Morales, Naco (HN); Jose Mayorga, Naco (HN); Arnold Martinez, Naco (HN); Melvin Fuentes, Naco (HN)

(73) Assignee: Lear Corporation, Southfield, MI (US)

( * ) Notice: Subject to any disclaimer, the term of this patent is extended or adjusted under 35 U.S.C. 154(b) by 556 days.

(21) Appl. No.: 14/851,372

(22) Filed: Sep. 11, 2015

(65) Prior Publication Data

US 2017/0072451 A1 Mar. 16, 2017

(51) Int. Cl.

| | |
|---|---|
| ***B21F 7/00*** | (2006.01) |
| ***B21F 15/04*** | (2006.01) |
| ***H01B 13/012*** | (2006.01) |

(52) U.S. Cl.

CPC ..... *B21F 7/00* (2013.01); *B21F 15/04* (2013.01); *H01B 13/01236* (2013.01)

(58) Field of Classification Search

CPC ..... B21F 7/00; B21F 15/04; H01B 13/0207; H01B 13/01236; D07B 3/005

See application file for complete search history.

(56) References Cited

U.S. PATENT DOCUMENTS

| | | | |
|---|---|---|---|
| 2,773,344 | A | 12/1956 | Van Hook |
| 2,835,283 | A | 5/1958 | Thone et al. |
| 2,944,380 | A | 7/1960 | Klapper et al. |
| 3,067,781 | A | 12/1962 | Dean et al. |
| 3,194,279 | A | 7/1965 | Brown |
| 3,946,768 | A | 3/1976 | Fiorentino |
| 4,368,614 | A | 1/1983 | Groza et al. |
| 4,979,544 | A | 12/1990 | Swindlehurst |
| 5,153,839 | A | 10/1992 | Cross |
| 5,168,904 | A | 12/1992 | Quinkert |
| 5,490,664 | A | 2/1996 | Justus et al. |
| 5,522,436 | A | 6/1996 | Tabuchi et al. |
| 5,526,562 | A | 6/1996 | Kita et al. |
| 5,535,788 | A | 7/1996 | Mori et al. |

(Continued)

FOREIGN PATENT DOCUMENTS

| | | | |
|---|---|---|---|
| JP | 2015053170 | A | 3/2015 |

OTHER PUBLICATIONS

International Search Report dated Nov. 18, 2016 for PCTUS16/50392.

*Primary Examiner* — Debra M Sullivan

(74) *Attorney, Agent, or Firm* — Fishman Stewart PLLC

(57) ABSTRACT

A system for twisting wire that includes an upper portion having a plurality of upper clamps configured to retain an upper wire end corresponding at least one wire pair. The upper portion may be selectively adjustable between a first vertical position and second vertical position. The system also includes a lower portion, disposed on vertically below the upper portion. The lower portion may include a plurality of lower clamps, each of the plurality of lower clamps may be configured to retain a first lower wire end and a second lower wire end corresponding to the at least one wire pair. The system may further include a controller configured to selectively rotate each of the lower clamps in response to instructions corresponding to a twisting program.

20 Claims, 9 Drawing Sheets

(56) References Cited

U.S. PATENT DOCUMENTS

| | | | | |
|---|---|---|---|---|
| 5,946,897 | A | 9/1999 | Ichikawa et al. | |
| 6,308,944 | B1 | 10/2001 | Ota et al. | |
| 6,769,536 | B2 | 8/2004 | Lutz | |
| 7,500,435 | B2 | 3/2009 | Bartlett, Jr. et al. | |
| 9,045,182 | B2 | 6/2015 | Cardani et al. | |
| 2014/0130345 | A1 | 5/2014 | Shinohara et al. | |
| 2014/0131170 | A1 | 5/2014 | Ookubo | |
| 2015/0101700 | A1* | 4/2015 | Stier ..... | H01B 13/0271 140/149 |

* cited by examiner

VERTICAL TWISTING SYSTEM AND METHOD

TECHNICAL FIELD

The present disclosure relates to a system and method for twisting wire pairs, including a system and method for twisting wire pairs in a vertical position.

BACKGROUND

Wire bundle suppliers rely on a variety of wire bundling machines and processes to meet wire bundling requirements. For example, a vehicle wire bundle supplier may generate a variety of wire bundles in order to fulfill wire bundle requirements for various vehicle suppliers and manufactures. In some applications, wire bundles may include twisted wire pairs. Twisted wire pairs consists of two wire segments twisted about each other.

Typically, wire bundle suppliers utilize wire twisting systems that include wire twisting machines. Wire twisting machines may be configured to twist two wire segments into a twisted wire pair. Additionally, wire twisting systems may commonly be arranged horizontally, such that wire segments extend horizontally into a wire twisting machine. However, in addition to at horizontal wire twisting machine having a relatively large footprint, operators of horizontal wire twisting machines may walk miles in a work day traversing the machine. Accordingly, a device or system that addresses some of the aforementioned challenges may be desirable.

SUMMARY

A system for twisting wire that includes an upper portion that includes a plurality of upper clamps configured to retain an upper wire end corresponding at least one wire pair. The upper portion can be selectively adjustable between a first vertical position and second vertical position. The system also includes a lower portion, disposed on a vertical plane relative to the upper portion, that includes a plurality of lower clamps, each of the plurality of lower clamps may be configured to retain a first lower wire end and a second lower wire end corresponding to the at least one wire pair. The system further includes a controller that may be configured to selectively rotate each of the lower clamps in response to instructions corresponding to as predefined twisting program.

In embodiments, a system for twisting wire may include an upper portion having a plurality of upper clamps configured to retain an upper wire end corresponding at least one wire pair. The upper portion may be selectively adjustable between a first vertical position and second vertical position. The system may also include a lower portion, disposed on a vertical plane relative to the upper portion, that includes a plurality of lower clamps. Each of the plurality of lower clamps may be configured to retain a first lower wire end and a second lower wire end corresponding to the at least one wire pair. The system may further include a wire guide disposed between the upper portion and the lower portion. The wire guide may be configured to guide wire segments corresponding to the at least one wire pair between the upper portion and the lower portion. The system may also include a pre-load device disposed adjacent to the upper portion configured to retain upper ends corresponding to at least one other wire pair, the pre-load device may be adjustable between an open and a closed position. The system may further include a controller configured to selectively rotate each of the lower clamps in response to instructions, for example, instructions corresponding to a predefined twisting program.

Various aspects of this disclosure will become apparent to those skilled in the art from the following detailed description of an embodiment of the present disclosure, when read in light of the accompanying drawings.

DETAILED DESCRIPTION

Reference will now be made in detail to embodiments of the present disclosure, examples of which are described herein and illustrated in the accompanying drawings. While the disclosure will be describer in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by appended claims.

Figure 1:
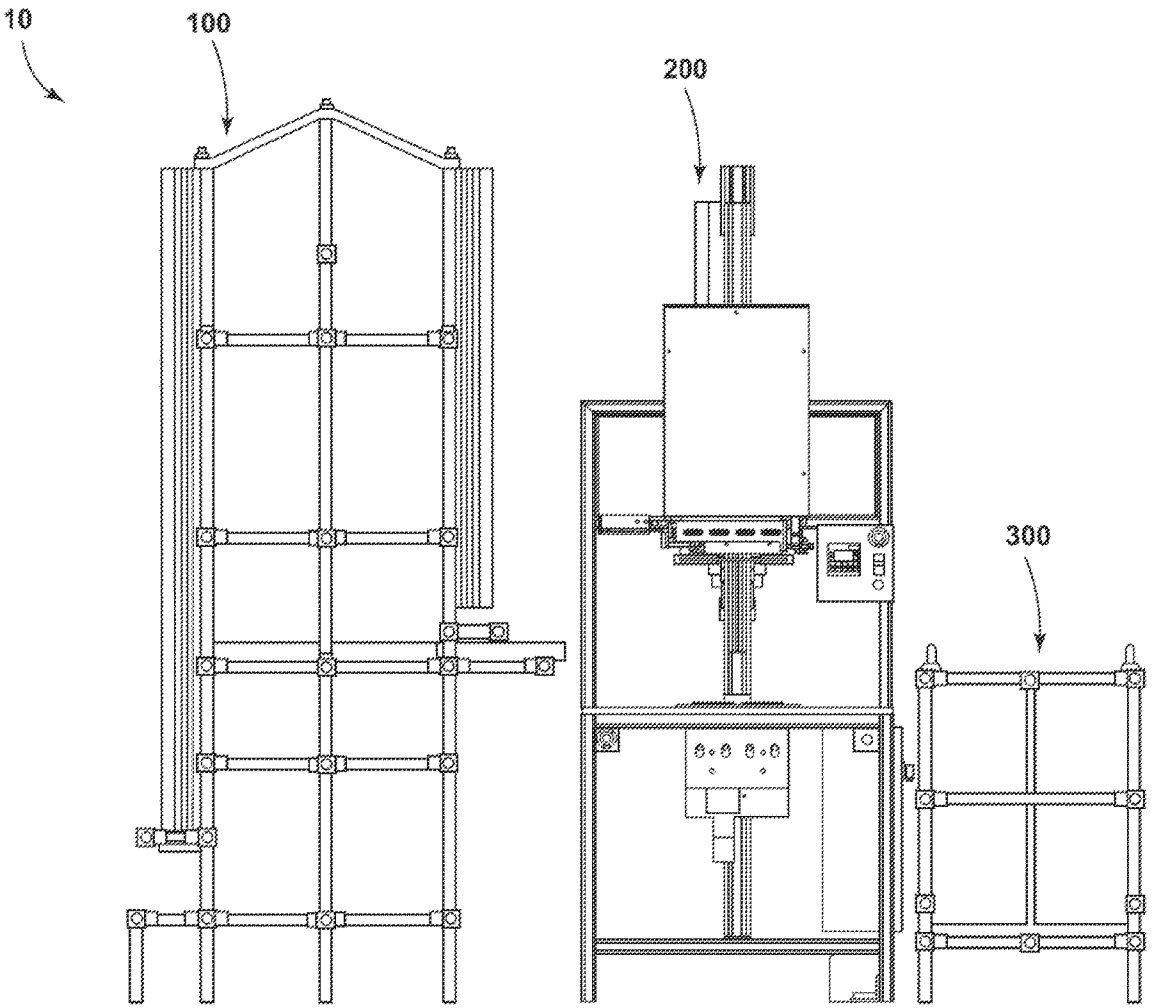
FIG. 1 generally depicts a front view of an exemplary vertical wire twisting system according to principles of the present disclosure.
Figure 2:
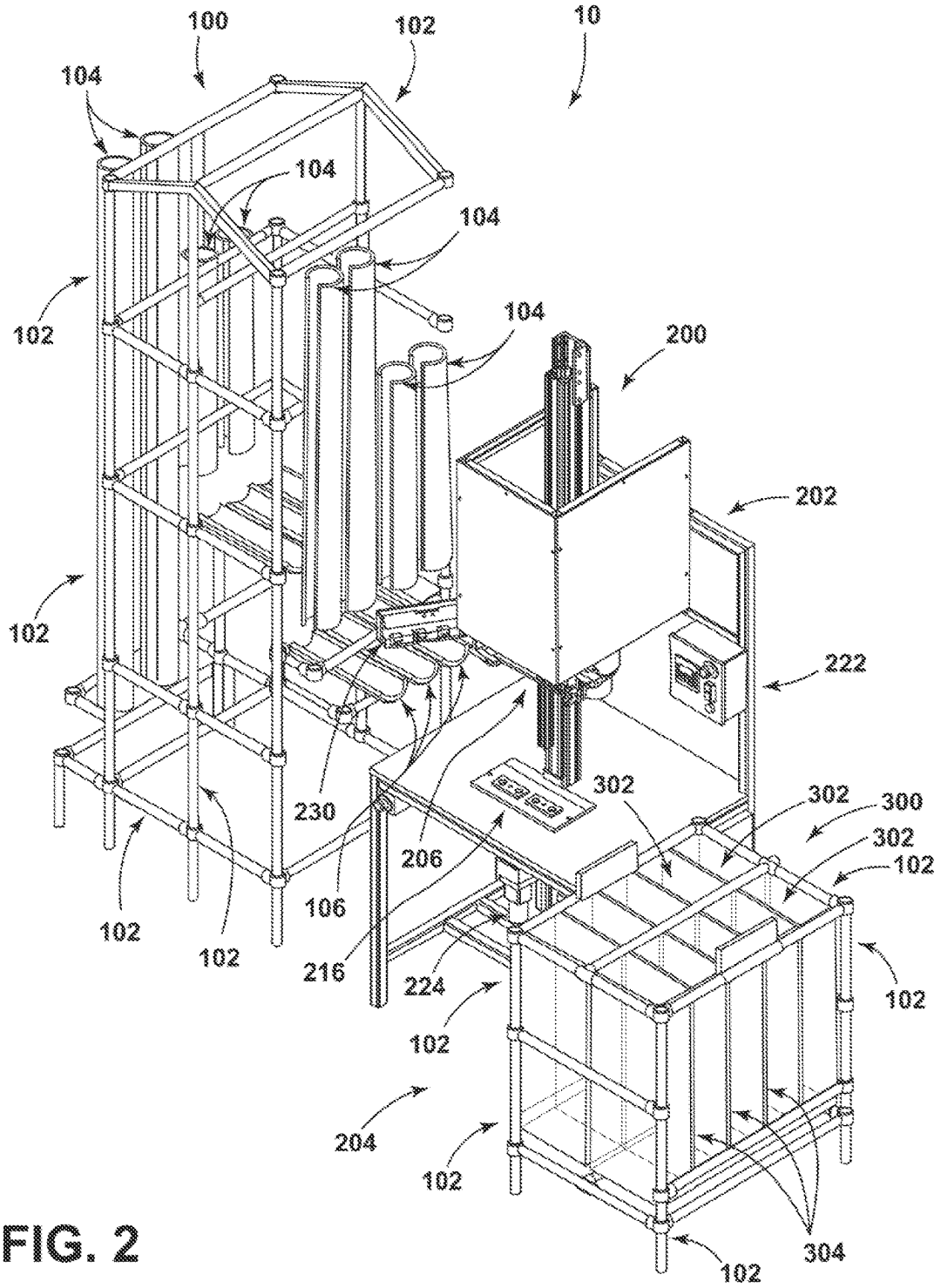
FIG. 2 generally depicts a perspective view of the vertical wire twisting system of FIG. 1.

Referring now to FIGS. 1 and 2, an embodiment of a vertical wire twisting system 10 is generally illustrated. The system 10 includes a rack 100, a vertical twisting machine 200, and a table 300. The rack 100 may include a plurality of frame members 102, such as generally illustrated in FIG. 2. The frame members 102 may be rigid bodies arranged such that the rack 100 conforms to a predefined shape, for example, as generally illustrated in FIGS. 1 and 2. It is understood that the rack 100 may be any suitable shape and/or size in addition to those illustrated.

Figure 3:
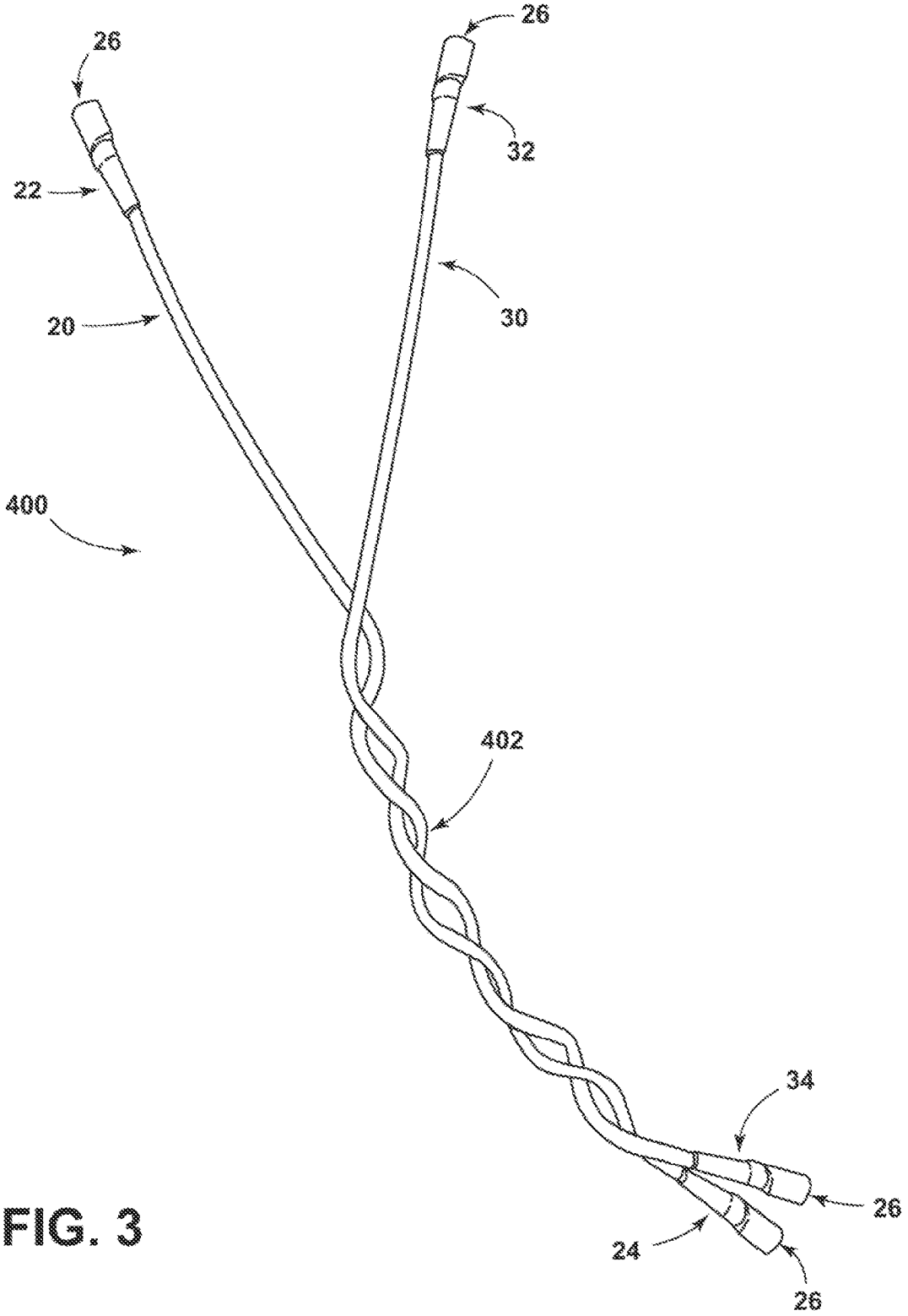
FIG. 3 generally illustrates a partially twisted wire pair according to principles of the present disclosure.

The rack 100 may be configured to retain a plurality of wire segments, for example, wire segments 20 and 30 illustrated in FIG. 3. In some embodiments, the rack 100 may include a plurality of retainers 104. The retainers 104 may be configured to retain plurality of wire segments of various lengths. By way of non-limiting example only, the wire segment 20 may comprise a segment of wire cut to a predetermined length. The length may, for example, be 50 millimeters (mm), 100 mm, 200 mm, or any suitable wire length.

The plurality of retainers 104 may be of various lengths and may extend as generally illustrated in FIG. 2. In embodiments, a retainer 104 of a first length may be configured to retain a wire segment of a first length. Similarly, a retainer 104 of a second length may be configured to retain a wire segment of a second length. It is understood that while only limited examples are described, the retainers 104 may be configured to retain any suitable length of wire segment.

Referring again to FIG. 3, the wire segment 20 may include a first end 22 and a second end 24, and the wire segment 30 may include a third end 32 and a fourth end 34. Each of the first end 22, second end 24, third end 32, and the fourth end 34 may include a wire terminator or connector 26. The connector 26 may generally comprise suitable wire connectors known in the art.

Referring again to FIG. 2, various lengths of wire may be cut or otherwise provided to form wire segments, such as the wire segments 20 and 30. Each of the first end 22, the second end 24, the third end 32, and/or the fourth end 34 may be terminated with a connector 26. The wire segment 20 may be placed or provided in one of the plurality of retainers 104, and the wire segment 30 may be placed or provided in another of the plurality of retainers 104. It is understood that while only limited examples are provided, a plurality of wire segments of various lengths may be retained in each of the plurality of retainers 104.

The rack 100 may also include a plurality of wire trays 106. Each of the trays 106 may be configured to receive and support a plurality of wire segments. By way of non-limiting example only, an operator of the system 10 may select a plurality of wire segments from the retainers 104, or any suitable location that may store wire segments. and place the wire segments (e.g., in a predefined order) on the wire trays 106. The plurality of wire segments may correspond to a wiring job or task. By way of example only, and without limitation, instructions may be received to prepare a wiring bundle for a vehicle. It is understood that the present disclosure contemplates wiring bundles corresponding to any suitable scenario. In embodiments, a wiring bundle may include a predefined number of wire segments at a first length and a predefined number of wire segments of a second length. It is understood that the principles of the present disclosure apply to wiring bundles for various wiring segment requirements.

The plurality of wire segments may be placed or provided in an order (e.g., a predefined order) on trays 106, such as described above. The order of wire segments may correspond to an order that the wires are to be bundled according to the instructions. In embodiments, when an operator is operating the vertical wire twisting machine 200, the operator may reach for one or more of the plurality of wire segments from the trays 106 to load the machine 200.

Referring again to FIG. 2, the illustrated vertical wire twisting machine 200 includes an upper portion 202 and a lower portion 204. The upper portion 202 is configured to receive a plurality of wire segment ends. For example only, and without limitation, the upper portion 202 may be configured to receive at least one wire pair, such as the wire pair 400. A wire pair may include two wire segments each with two corresponding ends, such as the wire segments 20 and 30 of the wire pair 400. The upper portion 202 may receive the first end 22 of the wire segment 20 and the third end 32 of the wire segment 30. In the above example, the upper portion 202 may further be configured to retain the first end 22 by the connector 26 corresponding to the first end 22 and to retain the third end 32 by the connector 26 corresponding to the third end 32.

The upper portion 202 may be configured to retain, for example, between one and four wire pairs simultaneously. In other embodiments, the upper portion 202 may be configured to retain any suitable number of wire pairs simultaneously.

Figure 4:
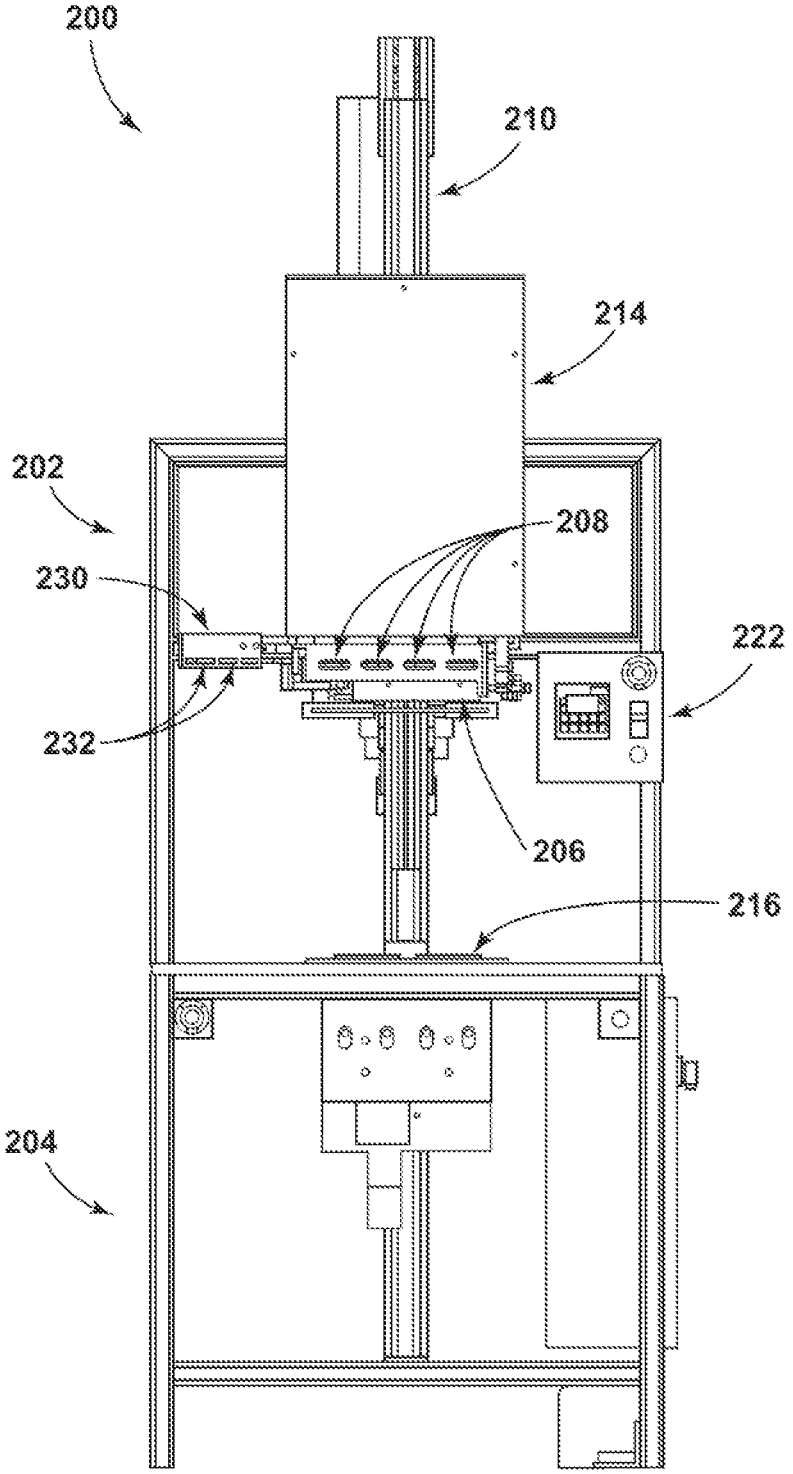
FIG. 4 generally depicts a front view of an exemplary vertical wire twisting machine according to principles of the present disclosure.

In some embodiments, the upper portion 202 includes an upper wire retainer 206, for example, as generally illustrated in FIG. 4. The upper wire retainer 206 may be disposed on a bottom portion of the upper portion 202. The upper wire retainer 206 may include one or more upper clamps 208. Each upper clamp 208 may be configured to receive one of the wire segments corresponding to a wire pair. Each upper clamp 208 may further be configured to retain the wire segments corresponding to a wire pair. For example, a first upper clamp 208 may retain the wire segment 20 of the wire pair 400. Additionally, a corresponding second upper clamp 208 may retain the wire segment 30 of the wire pair 400.

Figure 9:
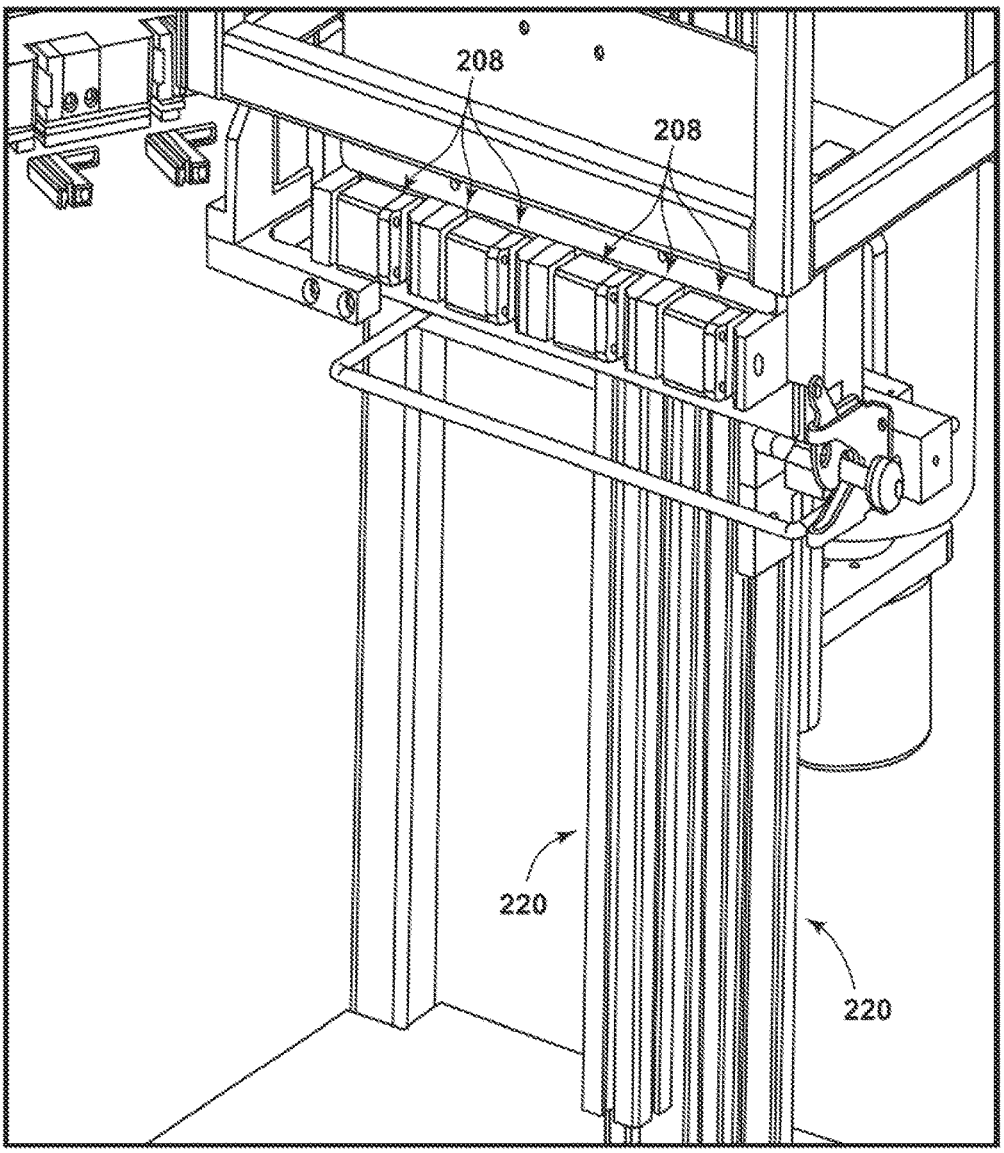
FIG. 9 generally depicts a perspective of the upper portion depicted in FIG. 8.

The upper clamps 208 may include a wire connector retainer. The wire connector retainer may be a suitable retainer capable of retaining a connector corresponding to a wire segment that is retained by the upper portion 202. For example, a connector 26 may press-fit into one of the upper clamps 208. It is understood the upper clamps 208 may be any suitable retainer configured to receive connectors corresponding to a wire segment. An embodiment of a upper clamp 208 is generally illustrated in FIG. 9.

The upper portion 202 may be configured to raise the retained wire pair(s) to a first vertical position. The upper portion 202 may, for example, retain the first end 22 and the third end 32, as described above. The machine 200 may raise the upper portion 202 to the first vertical position. In some embodiments, a loot pedal may be in communication with a drive chain 210. The foot pedal may be actuated to a first position. The foot pedal may be configured generate a position signal and/or communicate the position signal. The position signal may be indicative of a position of the foot pedal. For example only, when the foot pedal is actuated to the first position, the foot pedal may generate a position signal indicating the foot pedal is in the first position. The foot pedal may then communicate the position signal to the machine 200. As will be described in detail below, the machine 200 may include a controller 222. The controller 222 may be configured to receive the position signal. When the controller 222 receives the position signal, the controller 222 may instruct or control the machine 200 to raise the upper portion 202 to the first vertical position. It is understood that while only a foot pedal is described, the machine 200 may receive input from any suitable source that instructs the machine 200 to raise and/or lower the upper portion 202.

Figure 5:
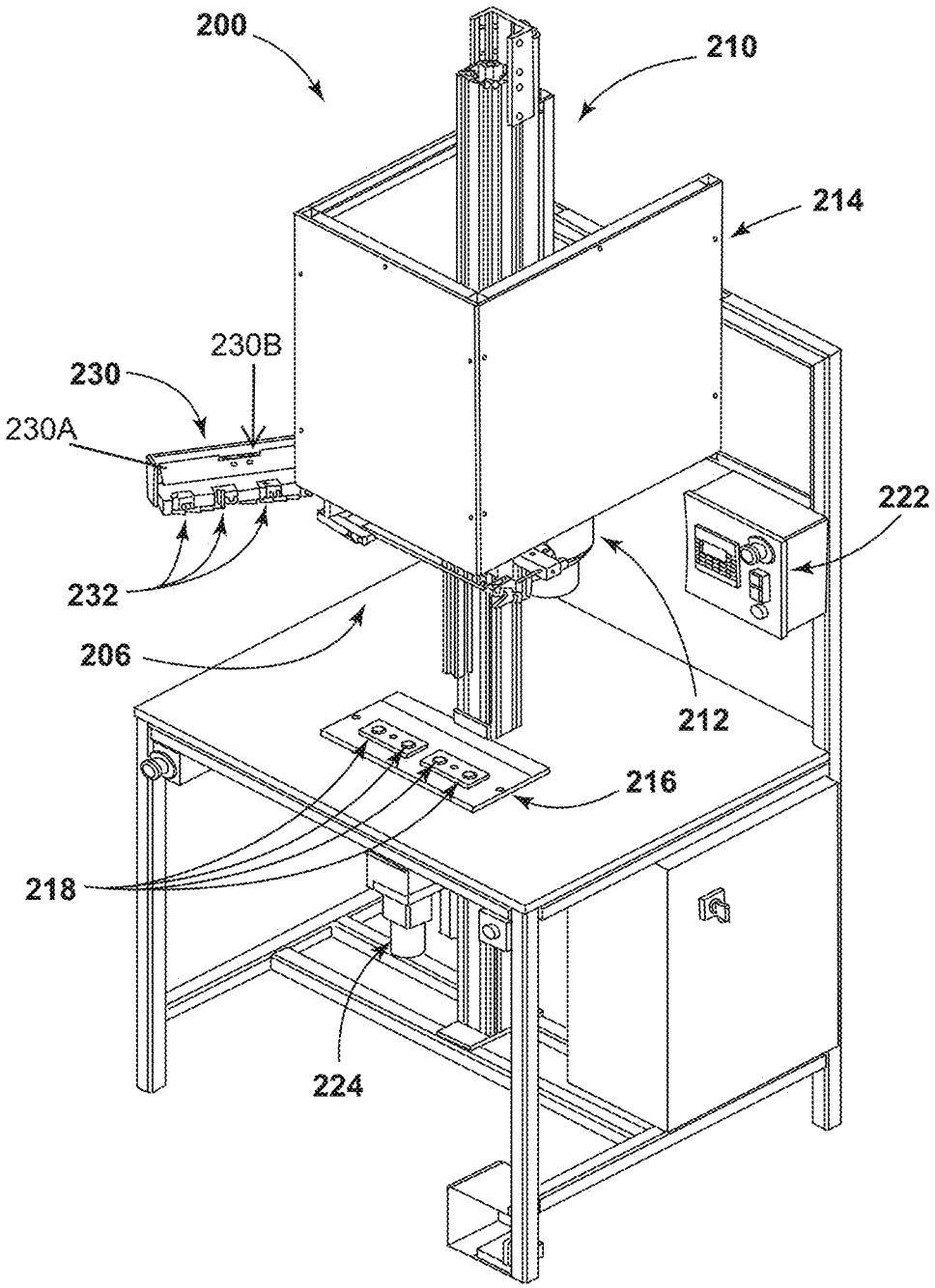
FIG. 5 generally depicts a perspective view of the vertical wire twisting machine of FIG. 4.

The drive chain 210 may be in communication with the upper portion 202. For example, the upper portion 202 may include an elevator 212, such as generally illustrated in FIG. 5. The elevator 212 may be driven by the drive chain 210. When the machine 200 receives instructions to raise the upper portion 202 (e.g., to a first vertical position), the drive chain 210 may actuate (e.g., turns), thereby raising the elevator 212, and consequently, the upper portion 202, to a first vertical position. The first vertical position may be a position at which the wire pair retained by the upper portion 202 hangs free between the upper portion 202 and the lower portion 204.

The upper portion 202 may include a protective guard 214. The guard 214 may surround the drive chain 210 to, among other things, separate or shield an operator from the drive chain 210. It is understood that while only the guard 214 is described, the system 10 may include various safety measures, such as emergency shut-offs, pressure shut-offs, or other suitable safety device known in the art.

The lower portion 204 may be configured to retain corresponding ends of wire pair(s) retained by the upper portion 202. For example, the lower portion 204 may be configured to retain the second end 24 when the upper portion 202 retains the first end 22 and the fourth end 34 when the upper portion 202 retains the third end 32. Similar to the upper portion 202, the lower portion 204 may be configured to retain between one and four wire pairs, or any suitable number of wire pairs.

Figure 7:
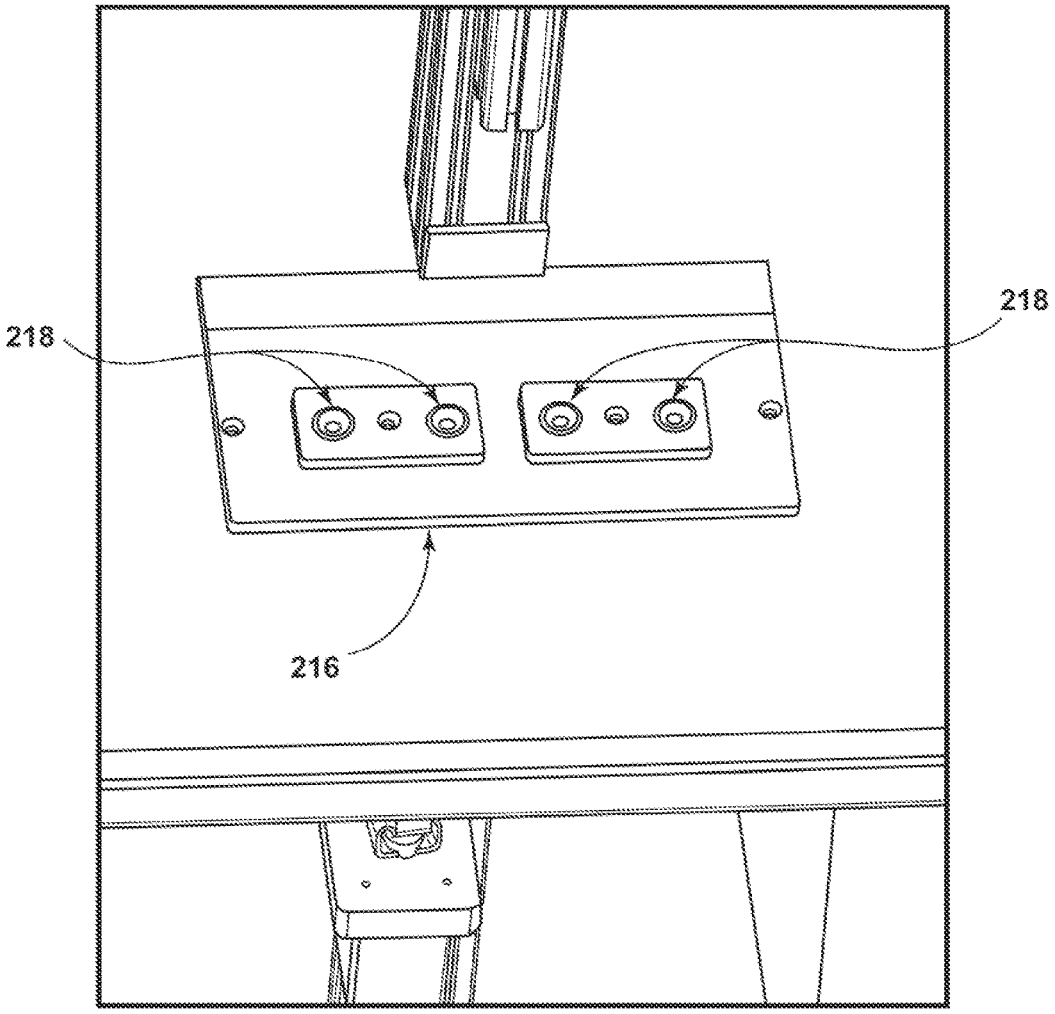
FIG. 7 generally depicts a top view of the lower portion depicted in FIG. 6.

In some embodiments, the lower portion 204 may include a lower retainer 216. The lower retainer 216 may be configured to retain corresponding ends of the wire segments retained by the upper wire retainer 206. In embodiments, the lower retainer 216 may include one or more lower clamps 218, such as generally illustrated in FIG. 7. Each lower clamp 218 may be configured to receive lower ends corresponding each wire segment of a wire pair. For example, such as described above, the connector 26 corresponding to the first end 22 may be retained by one of the upper clamps 208 and the connector 26 corresponding to the third end 32 may be retained by another of the upper clamps 208. In embodiments, each lower clamp 218 may correspond to two upper clamps 208. For example, a first lower clamp 218 may correspond to the upper clamp 208 that retains the first end 22 and the upper clamp 208 that retains the third end 32.

In some embodiments, the upper portion 202 may include a plurality of wire guides 220, such as generally illustrated in FIG. 9. Each of the plurality of wire guides 220 may correspond to one of the wire segments retained by the upper portion 202. As the upper portion 202 is raised to the first vertical position, the wire segments may be separated and/or guided by the wire guides 220. Each of the wire segments retained by the upper portion 202 may be separated and generally aligned parallel to one and other as the upper portion 202 is raised. The lower end corresponding to one of the retained wire segments may be identified by following a wire segment guided by the wire guides 220.

A lower end corresponding to a retained upper end may be inserted into one of the plurality of lower clamps 218. For example, such as described above, a first upper clamp 208 may retain the first end 22 and a second upper clamp may retain the third end 32. The second end 24 may correspond to the first end 22 and the fourth end 34 corresponds to the third end 32. A first lower clamp 218 may correspond to the first upper clamp 208 and the second upper claim 208. For example, the first lower clamp 218 may be generally directly below the first upper clamp 208 and the second upper claim 208. Each of the lower clamps 218 may include a divider that divides the lower clamp 218, for example, in half. In this way, a first lower end may be inserted on one side of the divider and a second lower end may be inserted on the other side of the divider.

In the above example, the second end 24 may be inserted into the first lower clamp 218 on one side of the divider and the fourth end 34 may be inserted into the first lower clamp 218 on the other side of the divider. The wire pair 400 may then be aligned between the first lower clamp 218 and the upper portion 202. It is understood that while only the wire pair 400 is described, the principles of the present disclosure apply to various wire segments retained by the upper portion 202.

Figure 6:
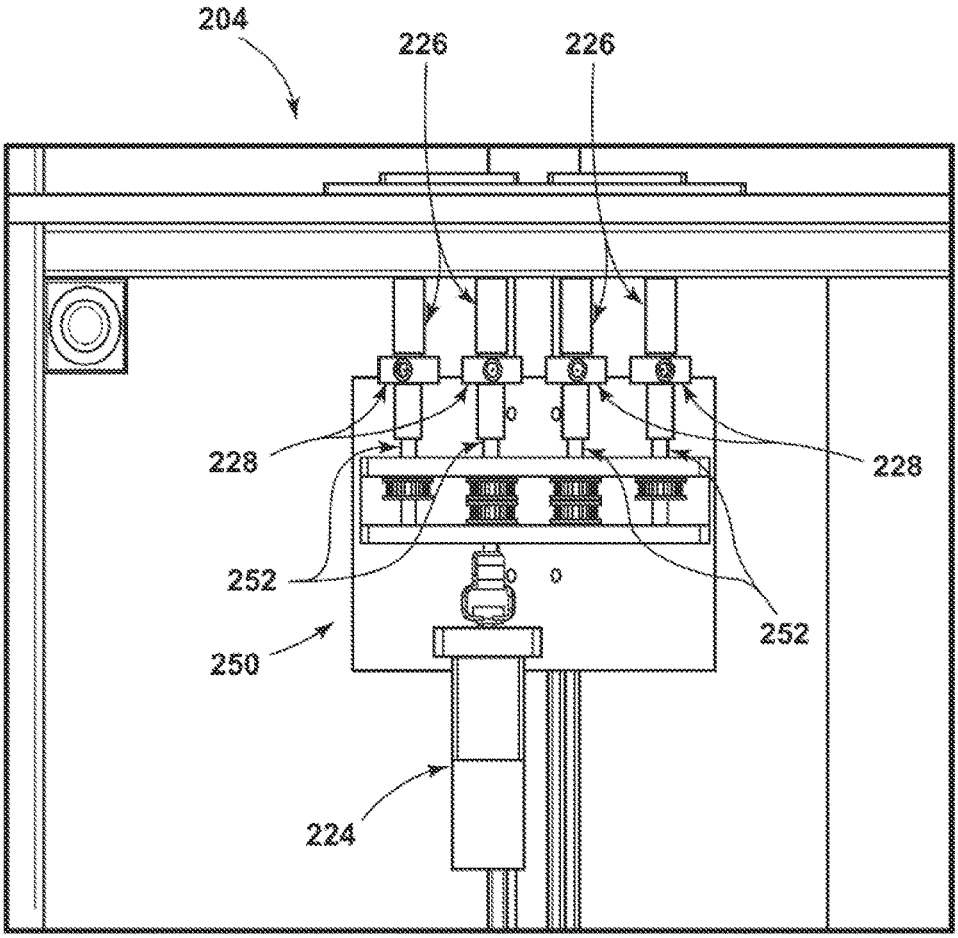
FIG. 6 generally depicts an lower portion of the vertical wire twisting machine of FIG. 4.

Each of the lower clamps 218 may be configured to retain the wire segment ends by retaining a connector 26 corresponding to each of the wire segment ends. The lower clamps 218 may retain the connector 26 by various known means. For example only, and without limitation, the connector 26 may be press fit into one of the lower clamp 218. In another embodiment, each of the lower clamps 218 may comprise an air pipe clamp. For example, each lower clamp 218 may include an air pipe 226 and an fill nozzle 228, such as generally illustrated in FIG. 6. Each of the fill nozzles 22$ may be configured to receive air from a compressor or other suitable source. The fill nozzles 228 may direct air from the compressor to corresponding air pipes 226. The wire segment ends may be retained in the air pipes 226 as an air pressure within each of the air pipes 226 increases to a predetermined pressure.

The machine 200 may be configured to raise the upper portion 202 to a second vertical position. For example, when the wire pair is retained by the lower portion 204, the machine 200 may receive a position signal. The position signal may indicate that the foot pedal is in a second position. The second vertical position may be a position at which the wire pair retained by the upper portion 202 and the lower portion 204 is taut or substantially without slack between the upper portion 202 and the lower portion 204.

The vertical wire twisting machine 200 may be configured to twist wire segments of a wire pair to form a twisted wire pair. As generally illustrated in FIG. 3, the wire pair 400 includes a twisted portion 402. It is understood that the machine 200 may be configured to twist a wire pair such that the entire length of the wire pair is twisted or a portion less than the entire length is twisted. As will be described below, in some embodiments, the machine 200 may be configured to twist a portion of the wire pair while leaving another portion of the wire pair untwisted.

The machine 200 may include a controller 222, such as generally illustrated in FIGS. 2, 4, and 5. The controller 222 may be any known controller. In some embodiments, the controller 222 may comprise a programmable logic controller (PLC). The controller 222 may be configured to selectively control twisting the wire pair 400 or any other wire pair. The controller 222 may be programmed to store one or more twisting programs. Each twisting program may define how many times the controller 222 twists the wire pair and in which direction the controller 222 twists the wire pair. The controller 222 may be configured to actuate or execute the twisting programs. In some embodiments, a switch may be actuated to initiate the controller 222. In embodiments, twisting programs may be selected via a user interface which may be provided, for example, on the controller 222. The controller 222 may then actuate or execute a twisting program. In another example, the controller 222 may be programmed to automatically actuate or execute a twisting program in response to the upper portion 202 being raised to the second vertical position. The controller 222 may include a processor and memory. The memory may be configured to store instructions corresponding to various twisting programs. The processor may be configured to execute the instructions stored on the memory.

In embodiments, the controller 222 may execute a first twisting program. The first twisting program may instruct the controller 222 to twist the wire pair 400 in a first direction for a number of turns and a then to twist the wire pair 400 in a second direction for a number of turns. For example only, and without limitation, the first twisting program may instruct the controller 222 to twist the wire pair 400 200 times in the first direction and then to twist the wire pair 400 fur times in the second direction. By twisting the wire pair 400 in a first direction and then in a second direction, the wire pair 400 may be more resistant to undesired untwisting when the twisting program is complete. It is understood that the twisting programs may instruct the controller 222 to twist the wire pair any number of turns in either direction.

Figure 8:
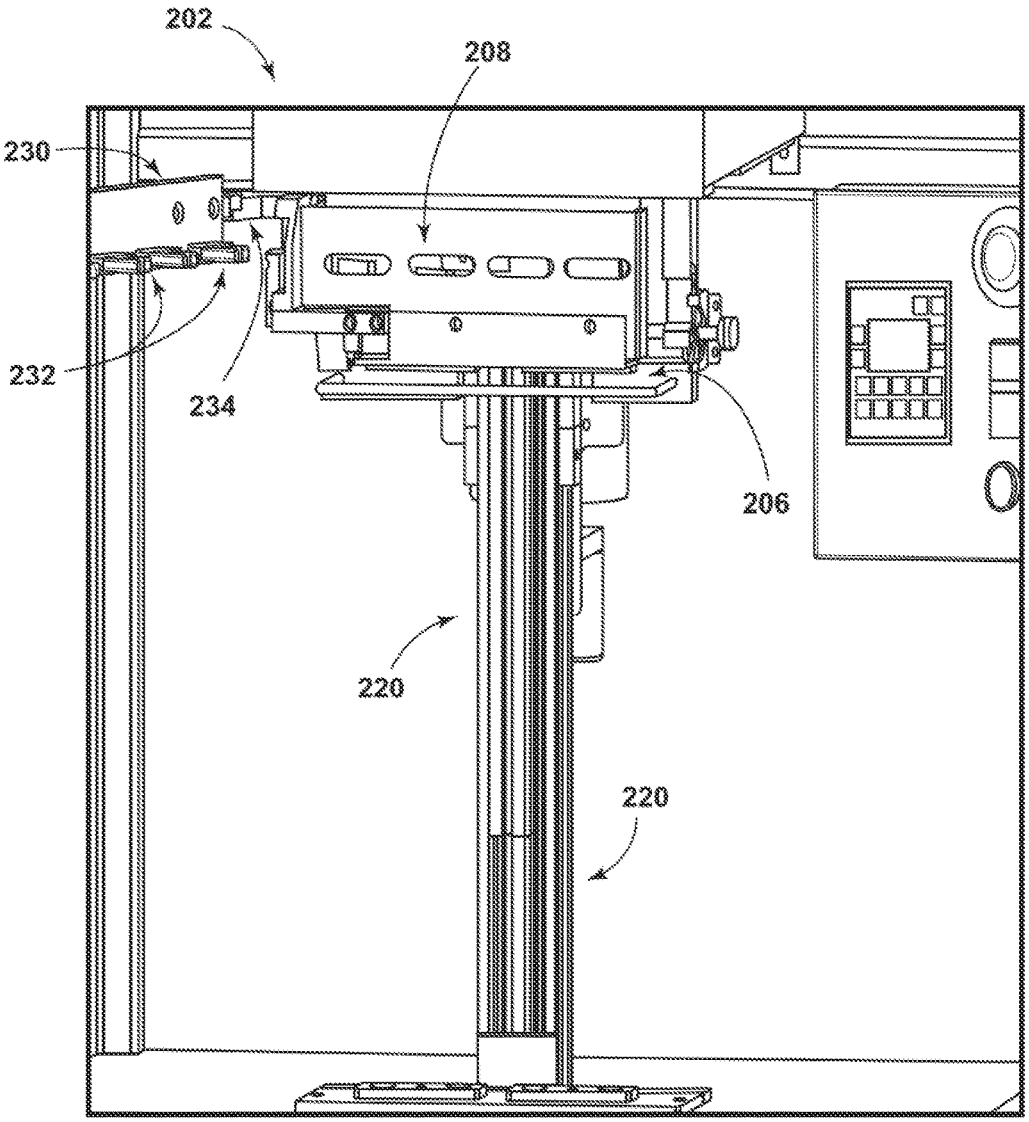
FIG. 8 generally depicts an upper portion of the vertical wire twisting machine of FIG. 4.

The controller 222 may be connected to or in communication with a servo motor 224, such as generally illustrated in FIGS. 8 and 9. For example, the controller 222 may be configured to send an electrical signal to the servo motor 224. The signal may instruct the motor 224 to turn at a predetermined rate. The controller 222 may instruct the motor 224 based on the twisting program, for example, as generally described above. The servo motor 224 may be in mechanical connection or communication with each of the lower clamps 218. As illustrated generally in FIG. 6, the motor 224 may be mechanically coupled to a transmission 250. The transmission 250 may be in mechanical connection or communication with a plurality of spindles 252. Each if the plurality of spindles 252 may correspond to one of lower clamps 218. The transmission 250 may turn each of the spindles in response to the motor 224 driving the transmission 250.

By rotating the plurality of spindles 252, while retaining the corresponding wire segment ends in the upper portion 202, the wire segments may twist about each other, thereby forming a twisted wire pair, such as illustrated generally in FIG. 3. As described above, the controller 222 may execute a twisting program to twist the wire pair according to a twisting program.

Alternatively, the system 10 may be configured to rotate each of the upper clamps 208. For example, the servo motor 224 may be in mechanical connection or communication with each of the upper clamps 208. The motor 224 may be mechanically coupled to an alternative transmission that may be in mechanical connection or communication with a plurality of alternative spindles. Each of the plurality of alternative spindles may correspond to one of the upper clamps 208. The alternative transmission may turn each of the alternative spindles in response to the motor 224 driving the alternative transmission.

By rotating the alternative spindles, while retaining the corresponding wire segment ends in the lower portion 204, the wire segments may twist about each other, thereby forming a twisted wire pair, such as illustrated generally in FIG. 3. As described above, the controller 222 may execute a twisting program to twist the wire pair according to a twisting program.

In some embodiments, the machine 200 may include a pre-load device 230, such as generally illustrated in FIGS. 2, 4, 5 and 8. The pre-load device 230 may be disposed adjacent to the upper wire retainer 206. As generally illustrated in FIG. 8, the pre-load device 230 may be coupled to the upper portion 202 via a hinge 234. The hinge 234 may be configured to allow the pre-load device 230 to move from an open position to a closed position, and vice versa. In the open position, the pre-load device 230 may be configured to receive a plurality of wire pairs. For example, while the machine 200 is executing a twisting program, a plurality of wire segments may be retrieved from the trays 106. The upper ends corresponding to the retrieved wire segments may then be loaded into the pre-load device 210.

The pre-load device 230 may include a plurality of pre-load clamps 232. The pre-load clamps 232 may include features similar to the upper clamps 208. For example, each of the pre-load clamps 232 may be configured to retain an upper end of a wire segment. Each of the pre-load clamps 232 may be loaded with wire segment ends corresponding to wire segments that will be twisted into twisted wire pairs via the machine 200. The pre-load device 230 may be pre-loaded with a subsequent batch of wire segments while the machine 200 is twisting a current batch of wire pairs. Among other things, this may save time in the wire bundling process.

When the twisting program is complete, the twisted wire pairs may be unloaded from the machine 200. After the upper portion 202 has been unloaded (e.g., all of the ends corresponding to the wire segments have been removed from the corresponding upper clamps 208), the pre-load device 230 may be closed such that the pre-load device 230 engages with the upper wire retainer 206. In some embodiments, the pre-load device 230 may be configured to align the pre-load clamps 232 with the upper clamps 208.

The pre-load device 230 may be configured to transfer the wire segments loaded in the pre-load device 230 to the upper wire retainer 206. For example, such as described above, the pre-load clamps 232 may be configured to align with the upper clamps 208 when the pre-load device 230 is in the closed position. The pre-load device 230 may be configured to eject the wire segments loaded in the pre-load clamps 232 such that the wire segments may be transferred into the upper clamps 208. The pre-load device 230 may eject the wire segments in response to the pre-load device 230 being closed. For example, the pre-load device 230 may include an ejection portion 230A that runs along the length of the pre-load device 230. The ejection bar 230A may include a tabbed portion 230B that protrudes beyond the pre-load device 230. When the pre-load device 230 is in the closed position, the tabbed portion 230B may be engaged by a portion of the upper portion 202. When the tabbed portion 230B is engaged, the ejection bar 230A may be forced forward, thereby forcing the wire segments from each of the pre-load clamps 232 and into corresponding upper clamps 208.

In some embodiments, the machine 200 may be configured to twist a portion of the wire pair and leave a portion of the wire pair untwisted. For example, the lower portion 204 may include a plurality air pipes 226, such as described above. The air pipes 226 may be a rubber boot or any suitable material. Each of the plurality of air pipes 226 may correspond to one of the lower clamps 218. As generally illustrated in FIG. 6, an air pipe 226 that corresponds to a lower clamp 218 may be disposed directly below the lower clamp 218. The air pipes 226 may be a predetermined length that corresponds to a length of wire that is to remain untwisted. For example, the machine 200 may receive instructions to twist a wire pair and include an untwisted portion of wire segment. An air pipe 226 corresponding to the predetermined length of untwisted wire segment may be selected from a plurality of air pipes 226 and inserted into the corresponding lower clamp 218. In other words, the air pipes 226 may be selectively replaceable.

The wire segments may be inserted into corresponding lower clamps 218, and thereby, into the air pipe 226 corresponding to each of the lower clamps 218. The air pipe 226 may receive a corresponding portion of the wire segment. The length of the portion of the wire segment may correspond to the length of the air pipe 226. When the controller 222 executes a twisting program, the corresponding air pipe 226 may retain the portion of the wire segment, thereby preventing the portion of the wire segment from twisting with a corresponding wire segment of the wire pair.

Once a twisting program is complete, the machine 200 may be configured to lower the upper portion 202 to an initial position in order to permit removal of the twisted wire pair(s) from the machine 200. When the upper portion 202 is lowered to initial position, the twisted wire pair may no longer be taut, allowing for the removal of the upper ends from the upper portion 202 and the lower ends from the lower portion 204. The upper portion 202 may automatically be lowered to the initial position in response to the completion of a twisting program.

The twisted wire pair(s) may be placed or provided in one of a plurality of storage areas 302 of the table 300. The table 300 may be comprised of it plurality of frame members 102 such as described with respect to the rack 100. The table 300 may also include a plurality of slates 304. Each of the plurality of slates 304 may be arranged within the table 300, such that the plurality of slates 304 and frame members 102 cooperate to form the plurality of storage areas 302, such as generally illustrated in FIG. 2.

As described above, a wire bundle may be comprised of a plurality of twisted wire pairs. Wire segments may be selected that correspond to the requirements of the wire bundle. The machine 200 may then be loaded with the selected wire segments. The machine 200 may then generate the plurality of twisted wire pairs from the selected wire segments. It is understood that the machine 200 may be loaded with up to four wire pairs (or more) simultaneously. The machine 200 may repeat the loading, twisting, and unloading processes until the machine 200 has generated the required twisted wire pairs corresponding to a desired wire bundle. The unloaded the twisted wire pairs may be placed or provided in a an order in the plurality of storage areas 302. The order may correspond to an order of the wire bundle. The wire bundle may then be wrapped in order keep the individual twisted wire pairs in order. An end cap may be placed on the plurality of corresponding ends of the twisted wire pairs Although only certain embodiments have been described above with as certain degree of particularity, those skilled in the art could make numerous alterations to the disclosed embodiments without departing tram the scope of this disclosure. Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." throughout the specification is to be construed broadly and is used to provide non-limiting examples of embodiments of the disclosure, and the disclosure is not limited to such examples. It is intended that all matter contained in the above description or shown in the accompanying drawings shall be interpreted as illustrative only and not limiting. Changes in detail or structure may be made without departing from the present disclosure as defined in the appended claims.

What is claimed is:

1. A system for twisting wire, the system comprising an upper portion that includes a plurality of upper clamps; each upper clamp of the plurality of upper clamps is configured to retain an upper end corresponding to at least one wire pair, the upper portion is selectively adjustable between a first vertical position and second vertical position;

a lower portion, disposed vertically below the upper portion; the lower portion including a plurality of lower clamps, each lower clamp of the plurality of lower clamps is configured to retain a first lower end and a second lower end corresponding to the at least one wire pair;

a pre-load device configured to receive a plurality of upper ends corresponding to at least one other wire pair; and a controller configured to selectively rotate each lower clamp of the plurality of lower clamps in response to instructions corresponding to a twisting program;

wherein the pre-load device is pivotally connected to the upper portion.

2. The system of claim 1, wherein the at least one wire pair includes a first wire segment and a second wire segment.

3. The system of claim 2, wherein the first wire segment includes a first upper end and a first lower end, and the second wire segment includes a second upper end and a second lower end.

4. The system of claim 3, wherein a first upper clamp of the plurality of upper clamps retains the first upper end of the first wire segment, and a second upper clamp of the plurality of upper clamps retains the second upper end of the second wire segment, and wherein a first lower clamp of the plurality of lower clamps retains the first lower end of the first wire segment and the second lower end of the second wire segment.

5. The system of claim 1, wherein the upper portion is adjusted to the first vertical position in response to a first position signal.

6. The system of claim 5, wherein at least one lower clamp of the plurality of lower clamps is loaded with the first lower end and the second lower end in response to the upper portion being adjusted to the first vertical position.

7. The system of claim 6, wherein the upper portion is adjusted to the second vertical position in response to a second position signal; and when the upper portion is adjusted to the second vertical position, the controller initiates rotation of each lower clamp of the at least one lower clamp.

8. The system of claim 1, wherein the pre-load device includes an ejection bar that extends along a length of the pre-load device.

9. The system of claim 1, wherein the pre-load device includes a plurality of pre-load clamps; and the pre-load device is configured to align the plurality of pre-load clamps with the plurality of upper clamps.

10. The system of claim 9, wherein the pre-load device is configured to automatically transfer at least one other wire pair from the pre-load device to the upper portion in response to the pre-load device being closed onto the plurality of upper clamps.

11. A system for twisting wire, the system comprising an upper portion that includes a plurality of upper clamps; the upper clamps are configured to retain an upper end corresponding to at least one wire pair, the upper portion is selectively adjustable between a first vertical position and second vertical position;

a lower portion, disposed vertically below the upper portion; the lower portion including a plurality of lower clamps, each of the plurality of lower clamps is configured to retain a first lower end and a second lower end corresponding to the at least one wire pair;

a pre-load device disposed adjacent to the upper portion; the pre-load device is configured to retain upper ends corresponding to at least one other wire pair, the pre-load device is adjustable between an open and a closed position; the pre-load device includes an ejection portion having a tabbed portion configured to be engaged by the upper portion to release the at least one wire pair; and a controller configured to selectively rotate each of the lower clamps in response to instructions corresponding to a twisting program.

12. The system of claim 11, wherein the at least one wire pair includes a first wire segment and a second wire segment; a first wire guide is configured to guide the first wire segment; and a second wire guide is configured to guide the second wire segment.

13. The system of claim 12, wherein the first wire segment includes a first upper end and a first lower end, and the second wire segment includes a second upper end and a second lower end.

14. The system of claim 13, wherein a first upper clamp of the plurality of upper clamps retains the first upper end of the first wire segment, and a second upper clamp of the plurality of upper clamps retains the second upper end of the second sire segment, and wherein a first lower clamp of the plurality of lower clamps retains the first lower end of the first wire segment and the second lower end of the second wire segment.

15. The system of claim 11, wherein the upper portion is adjusted to the first vertical position in response to a first position signal and the upper portion is adjusted to the second vertical position in response to a second position signal.

16. The system of claim 15, wherein at least one lower clamp of the plurality of lower clamps is loaded with the first lower end and the second lower end in response to the upper portion being adjusted to the first vertical position.

17. The system of claim 16, wherein when the upper portion is adjusted to the second vertical position, the controller initiates rotation of each lower clamp of the plurality of lower clamps.

18. The system of claim 11, wherein the pre-load device includes a plurality of pre-load clamps and the pre-load device is configured to be pre-loaded with additional wire segments while the lower clamps rotate.

19. The system of claim 11, further comprising a vertical wire storage rack that is configured to store a plurality of wire segments prior to the wire segments being loaded into the upper and lower portions.

20. The system of claim 11, further comprising a table that includes a plurality of storage areas, wherein the storage areas are configured to receive twisted wire pairs that are unloaded from the upper and lower portions.

* * * * *